US005377362A

United States Patent [19]

Jackson

[11] Patent Number: 5,377,362

[45] Date of Patent: Jan. 3, 1995

[54] COMBINED SINK STRAINER STOPPER AND SCRUB BRUSH

[76] Inventor: Ingrid Jackson, 12455 Briones Way, Los Altos, Calif. 94022

[21] Appl. No.: 932,769

[22] Filed: Aug. 20, 1992

[51] Int. Cl.[6] ..... E03C 1/262

[52] U.S. Cl. ..... 4/292; 4/288; 4/629; 4/628; 15/160

[58] Field of Search ..... 15/105, 160, 191.1, 15/194, 167.3, 159.1, 245; 4/286, 287, 288, 292, 293, 295, 629, 628; 241/32.5, 46.013, 46.014, 46.015, 46.016; D23/261; D4/116

[56] References Cited

U.S. PATENT DOCUMENTS

| | | | |
|---|---|---|---|
| 158,120 | 12/1874 | Porter | 4/287 |
| 322,961 | 7/1885 | Neale | 4/287 |
| 659,514 | 10/1900 | Duffy | 4/287 |
| 831,767 | 9/1906 | Boden | 4/287 |
| 1,053,875 | 2/1913 | Repper et al. | 4/286 |
| 1,243,472 | 10/1917 | Wilson | 15/159.1 |
| 1,333,146 | 3/1920 | Wilson | 15/191.1 |
| 1,617,569 | 2/1927 | Boyle | 15/159.1 |
| 1,660,010 | 2/1928 | Lemm | 4/287 |
| 1,935,128 | 11/1933 | Pullman | 4/286 |
| 2,166,273 | 7/1939 | Ulmer | 4/287 |
| 2,283,293 | 5/1942 | Steiert | 15/194 |
| 2,516,778 | 7/1950 | Kreidenweiss | 15/191.1 |
| 2,539,211 | 1/1951 | Smith, Jr. | 15/191.1 |
| 4,504,996 | 3/1985 | Loos | 15/105 |
| 4,635,313 | 1/1987 | Fassler et al. | 15/193 |
| 4,763,380 | 8/1988 | Sandvick | 15/160 |
| 4,912,801 | 4/1990 | Hammil | 15/160 |

FOREIGN PATENT DOCUMENTS

| | | | |
|---|---|---|---|
| 141420 | 4/1920 | United Kingdom | 4/287 |

*Primary Examiner*—Stephen F. Gerrity
*Assistant Examiner*—Tony G. Soohoo
*Attorney, Agent, or Firm*—Skjerven, Morrill, MacPherson, Franklin & Friel

[57] ABSTRACT

A combined sink strainer and scrub brush unit (10) with or without a sink stopper disc (14) is provided which seats into a garbage disposal inlet (31) depending from a sink bottom (30*a*). A horizontal strainer base (11) has a series of drain apertures (17) therein and a series of spaced brush elements (12) either molded with the base (11) or attached to the base and depending from the base (11). A handle (15) is attached to the base (11) for manual removal of the unit (10) from the disposal inlet (31) and for hand-manipulating the unit (10) to scrape/scrub foodstuff and other debris from dish plates, cooking pots, and sink surfaces into the sink (30) and disposal inlet (31). A rubber stopper disc (14) is mounted on top of base (11) for rotational and sliding movement thereon. Radial drain holes (18) in the disc (14) are alignable with the base drain apertures (17) in a drain "open" position and are offset therefrom in a drain "closed" sealing position.

21 Claims, 4 Drawing Sheets

COMBINED SINK STRAINER STOPPER AND SCRUB BRUSH

BACKGROUND OF THE INVENTION

1. Field of the Invention

This invention pertains to a combined sink strainer and sink-pot-and dish-cleaning scrub brush unit seatable in a garbage disposal inlet. More particularly, the invention is directed to a perforated sink strainer which seats into a disposal inlet which may or may not include a sink stopper but which includes a depending tufted scrub brush.

2. Material Prior Art

A standard part of particular a kitchen sink is a circular sink strainer often having a relatively-flat cup-like configuration including oval or circular perforations on the peripheral side wall of the strainer. Spaced rows of circular perforations extend in a circular direction along the strainer horizontal bottom in an annulus between the peripheral upstanding wall and a central generally imperforate portion. The central portion may contain a fixed upstanding handle for removing the strainer from the disposal circular inlet. The handle may also be attached to a handle-operated drain plug extending under the exterior under surface of the strainer bottom. In drain-open mode of operation any foreign foodstuff or other matter of a size which might plug the sink drain piping including a drain trap is caught by the perforations and can be disposed of by the householder either in a garbage receptacle or flushed into the sink waste disposal. Any water in the sink or small particles can be easily flushed through the respective strainer perforations. The usual householder normally has a separate sponge, abrasive or filimented square or pot-scrubbing brush which is kept on, under or adjacent to the sink, for example, on the sink or countertop or in a separate dish. Thus, in cleaning up or scraping dirty dishes, pots or the sink itself, a separate tool is necessarily employed which tool may be easily mislaid or become particularly entangled with the fibrous or other material being removed from the dish, pot or the sink itself. A separate cleaning of the sponge, square or pot brush is normally necessary. When it is desired to stop water flow from the sink into the disposal in order to fill the sink with later for a washing or soaking operation in many cases a separate rubber or plastic/rubber or metals/rubber stopper or plug must be used, thus necessitating a third separate tool. Thus, it is apparent that a need has existed for many years in having one instrument for both sink straining and sink-pot-and dish-cleaning as well as having the capability of providing a sink stopper.

U.S. Pat. No. 1,935,128 shows a strainer trap in which an inverted convex perforated disk covers a sink outlet and connects to a long spiral wire mounting radial bristles depending down into the sink drain. The spiral wire, bristles-containing, brush is similar to a baby bottle cleaning brush but functions to trap, collect and gather "all hairs and grease contained in the debris or refuse that may be emptied in the waste pipe." Upon removal of the vertically depending brush, the diametric bristles contact and clean the drain walls. U.S. Pat. No. 4,418,432 and 4,671,976 show filamentary elements either attached to or positioned as a ring or barrier around a stopper or strainer drain, which again are designed to catch debris such as hair from being flushed into the drain trap and causing plugging thereof.

SUMMARY OF THE INVENTION

In a first embodiment of the invention, a plastic or metal circular strainer base is provided having a series of radial drain apertures extending therethrough. A series of brush elements are mounted in or are integrally formed between the drain apertures to extend downwardly from the underside of the strainer base. A handle is connected to or extends integrally upward from the strainer base to permit hand-manipulative positioning and removal of the combined strainer and attached brush from a sink drain opening. A flat stopper disc containing a series of drain holes preferably matching the pattern of the base drain apertures overlies the strainer base and is rotatable and slidable with respect to the strainer base in a first drain position to align the disc holes with the base drain apertures and in a second stopper position to offset the disc drain holes from the base drain apertures so that intervening imperforated portions of the stopper disc align with the strainer base apertures to effectively seal the base drain apertures. The stopper disc is of rubber or flexible plastic construction so that it effectively provides an overall annular seat over the entire radial pattern of strainer base drain apertures. Spaced radial integral tabs extend upwardly from the stopper disc which tabs may be pushed to rotate the disc about 5°–12° dependent on the number of spaced radial apertures and holes in either direction of rotation so that each imperforate radial portion of the stopper disc overlies one of the drain apertures in the drain "closed" position. The stopper disc holes, by reason of an appropriate rotation, are aligned with the base drain perforations in the drain "open" position. In use, the combined strainer based scrub brush and stopper disc unit is placed in the sink drain/disposal inlet for scrub brush storing and automatic cleansing by the action of flush water exiting the sink through the strainer base or for retention of water in the sink by rotation of the stopper disc. When a manual scrubbing operation is to be performed on the sink, countertop, dish or pot the overall assembly is merely removed from the sink drain/disposal inlet by grasping the handle and in that held position the user can use the device brush portion as desired.

In a second embodiment of the invention, a combined sink strainer and dish-pot-sink scrubbing brush unit is provided by inclusion of a series of tufted brush elements having base portions affixed or integral with an essentially horizontal strainer bottom and having distal ends depending from the underside of the strainer bottom. The tufted brush elements preferably extend from and are mounted in circular rows of apertures extending circularly around the strainer bottom and concentric to the circular rows of bottom open strainer drain perforations. A cylindrical top section of each tufted elements may be mounted from the underside of the strainer bottom through its respective circular aperture and a portion then extending above the strainer bottom upset, as a rivet head, to hold the tufted element in the strainer bottom. A tuft flange abuts the strainer underside and a series of integral flexible fingers, such as eleven fingers downwardly splay-out from the flange, forming the brush bristles. Since each of the tufts and particularly the integral assemblage of fingers, extend on all sides next to an open drain perforation of the strainer bottom and the most peripherally-outward of the fingers in the outermost circular row of tufts are positioned to receive draining water exiting from the strainer side apertures, the entire array of flexible fingers are constantly flushed and cleaned by downwardly-cascading drain water. The combined device can also be cleaned by placing it in an adjacent dish washer. A further advantage is that the scrub brush is "stored" automatically in the sink drain/disposal inlet out of sight and always easily available for use.

A strainer handle extends upwardly from a central portion of the strainer and upon removal of the strainer and combined brush from the sink drain, the one-piece mechanism can continue to be grasped by the users thumb and fingers and the depending flexible brush fingers used to clean-off food particles from a dish, food particles sticking to a pot prior to dish or pot washing, or wiping/cleaning the surface of the sink or the adjacent countertops. There is no need of swivelling a sink faucet spout and using additional flush water to hydraulically move particles in the sink bottom into the disposed inlet. Thus, the use of the device aids in conservation of water. Further, there is no need of using one's fingers to push debris into the disposal inlet since a brush is always at hand in the disposal inlet.

If foodstuff particles or fibrous or other debris is picked up by the brush fingers, these can be removed rather automatically when the combined strainer and drain are reinserted into the sink outlet/disposal inlet and draining water flushed through the strainer. This flushing action acts to remove all debris material from the flexible fingers and around the tuft fingers and deposit the debris into the disposal.

In a third embodiment of the invention, a cup-like strainer is made of non-scratch plastic material and the flexible fingers are integral therewith depending from the strainer bottom between a circular array of drain apertures or apertures of other orientation in the bottom of the strainer.

DETAILED DESCRIPTION

Figure 1:
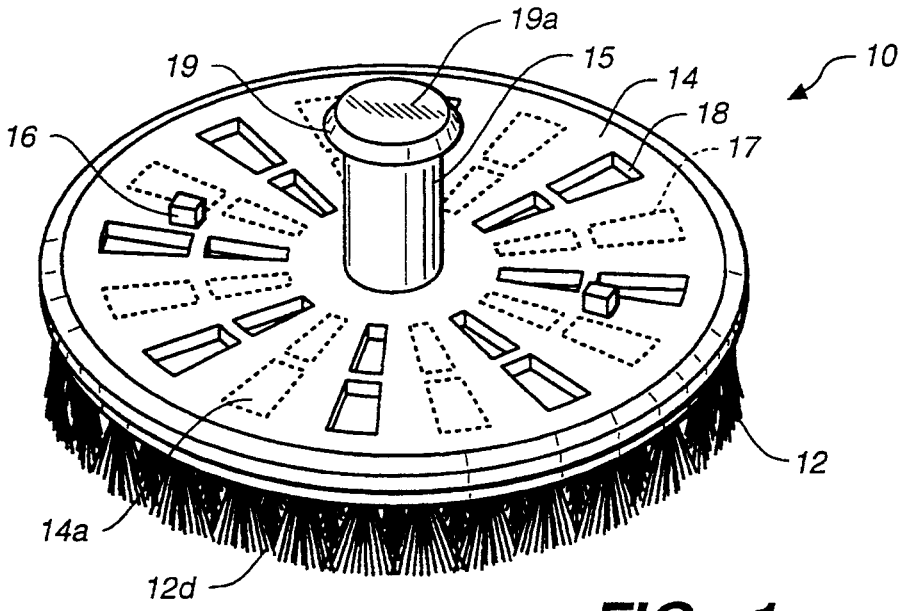
FIG. 1 is a perspective view of the combined strainer and scrub brush and incorporating a drain stopper.
Figure 2:
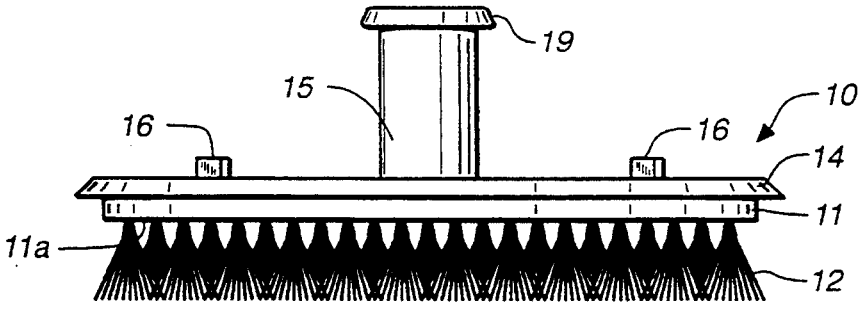
FIG. 2 is a side view thereof.
Figure 10:
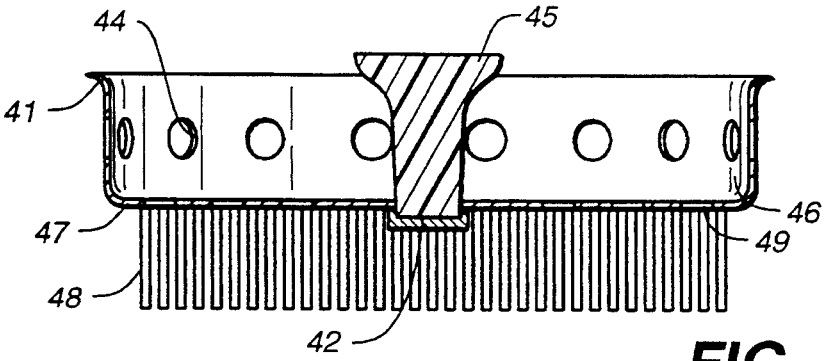
FIG. 10 is a cross-sectional view thereof taken on the line 10—10 of FIG. 9.

A combined sink strainer and scrub brush 10 is seen in FIGS. 1 and 2 wherein an essentially horizontal circular strainer base 11 includes a series of spaced drain perforations 17 extending through the base. The perforations 17 preferably extend radially as spaced pairs of openings from the center of the base. A handle 15 is attached to the base by a bottom connector nut 42 (FIG. 10) or is of integral one-piece construction with the strainer base 11. A series of spaced brush elements 12 each extend substantially orthogonally and downward from an underside 11*a* of the base. A base top end of the brush elements are mounted to or in the base between the drain perforations 17. The brush elements may be of integral one-piece construction with the base. The brush elements have flexible distal ends 12*d* which together form the integral scrub brush extending below the strainer base.

In a preferred embodiment of the invention, the combined strainer base and brush includes a rotatable stopper disc 14 of flexible rubber such as Santoprene TM from Advanced Elastomer System or plastic material which is pre-assembled on or inserted down over the handle 15 to seat on top of strainer base 11. The disc may be stretched so that aperture 22 (FIG. 3) passes over the top 19 of the handle 15. The disc 14 has a series of radial drain holes 18 generally conforming in size and orientation to the series of drain apertures 17 in the strainer base 11. In a first rotational position, the drain holes 18 are aligned with the base drain apertures 17 to allow water flow through both the disc and base and in a second rotational position the disc holes are offset by about 5° to about 15° from the base drain apertures dependent on the number of pairs 18*a* and 18*b* of drain apertures and disc holes. For example, with 8 equispaced pairs of radial apertures, a movement of 11°–12° will seal the drain apertures, while with 16 pairs, a 5°–6° rotation will be sufficient. In that second position, an intermediate web 14*a* of an imperforate portion of disc 14 fits and seals over a respective one of the base drain apertures 17 to place the stopper in a drain "closed" position. A pair of upstanding molded tabs or turning knobs 16 facilitate hand rotation (rotory sliding) of disc 14 on the top surface of strainer base 11. In a stopper "closed" condition, the weight of the water filling the sink will insure the sealing off of the apertures 17 by the webs 14*a*. In the preferred embodiment, the diameter of disc 14 is about 84 mm while the diameter of the strainer base is about 80 mm allowing the unit 10 to be placed in a typical disposal inlet.

Figure 3:
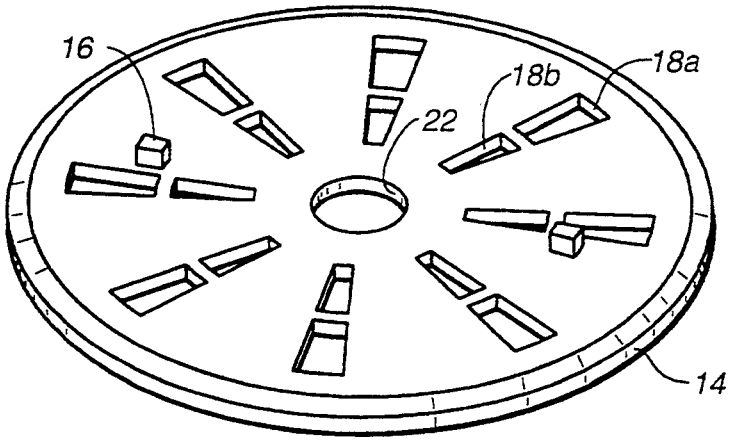
FIG. 3 is a perspective view of a stopper disc per se.

As seen in FIG. 3, the stopper disc holes 18 preferably comprise a series of spaced pairs of radially aligned holes 18*a* and 18*b* which are sized to allow food particles and other debris to pass into the disposal inlet but which will catch any valuables such as a ring or spoon which otherwise would drop into the disposal.

Figure 4:
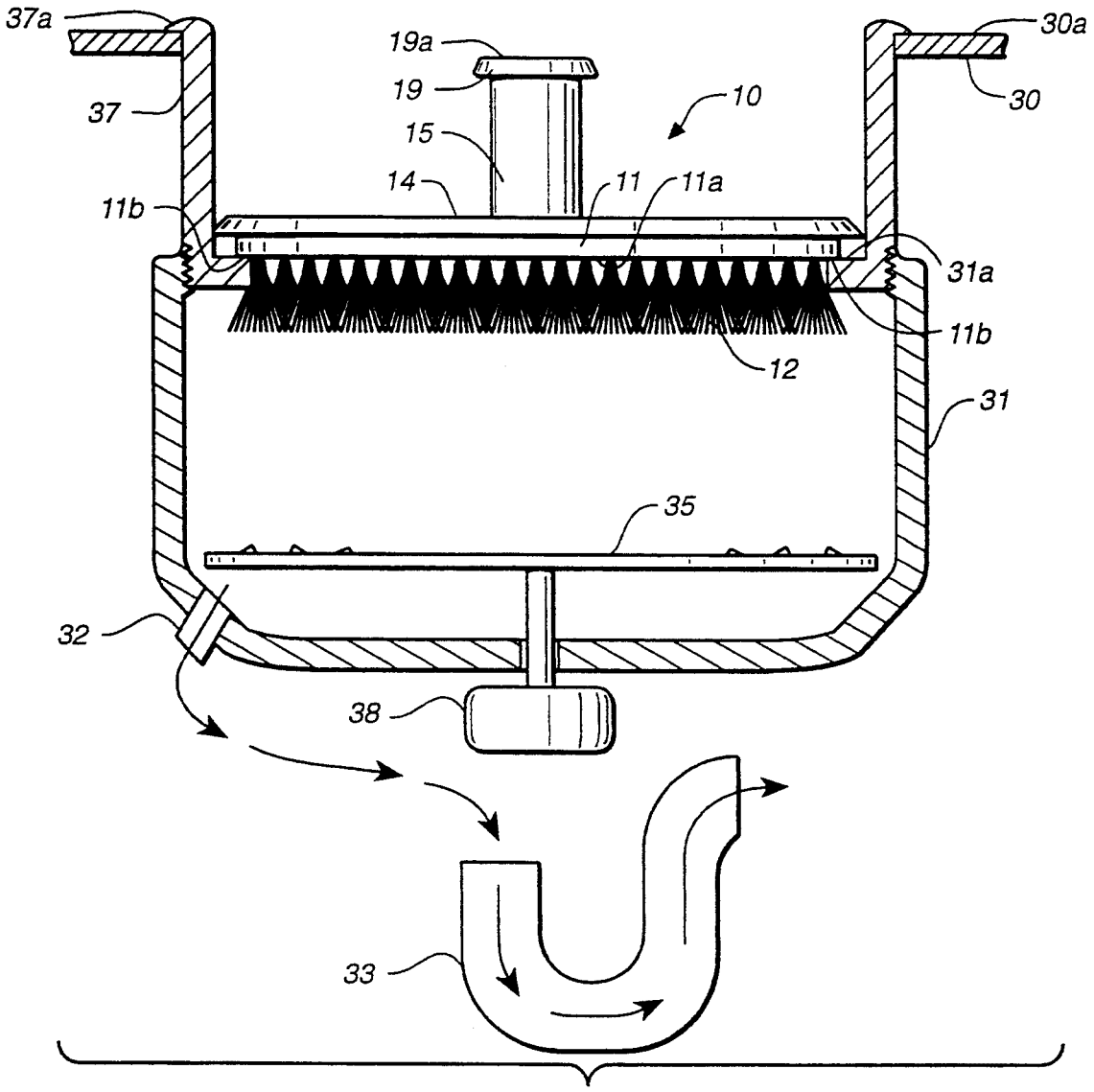
FIG. 4 is a side view of the combined strainer, brush and stopper positioned in a sink drain and disposal top inlet.

FIG. 4 illustrates the seating of the combined strainer base/stopper disc/scrub brush 10 in a disposal 31 dependingly installed in a sink 30. The peripheral lip 11*b* on the underside 11*a* of the base 11 seats on an interior peripheral ridge 31*a* in the disposal. Details of the disposal mounting in the sink are not shown. As water flushes from sink 30 down past handle 15 and through the disc holes and strainer base apertures in a drain "open" position of the stopper disc, the cascading flush water tends to clean the brush elements 12 and remove any debris thereon. Such debris will drop into the disposal 31 proper to be comminuted by a grinder plate 35 driven by disposal motor 38. The ground-up material will exit through port 32, into a sink trap 33 and to the household waste pipe (not shown). A typical disposal mounting cylinder 37 forming a disposal inlet is screw threaded attached to the disposal 31 and includes a sealing/mounting rim 37*a* extending over the sink bottom surface 30*a*. The top 19*a* of handle 19 is at or just below the level of the sink bottom surface 30*a* so as not to interfere with dishes or pots placed horizontally in the sink. The handle is typically about 4 cm. in length to provide a satisfactory gripping surface.

Figure 5:
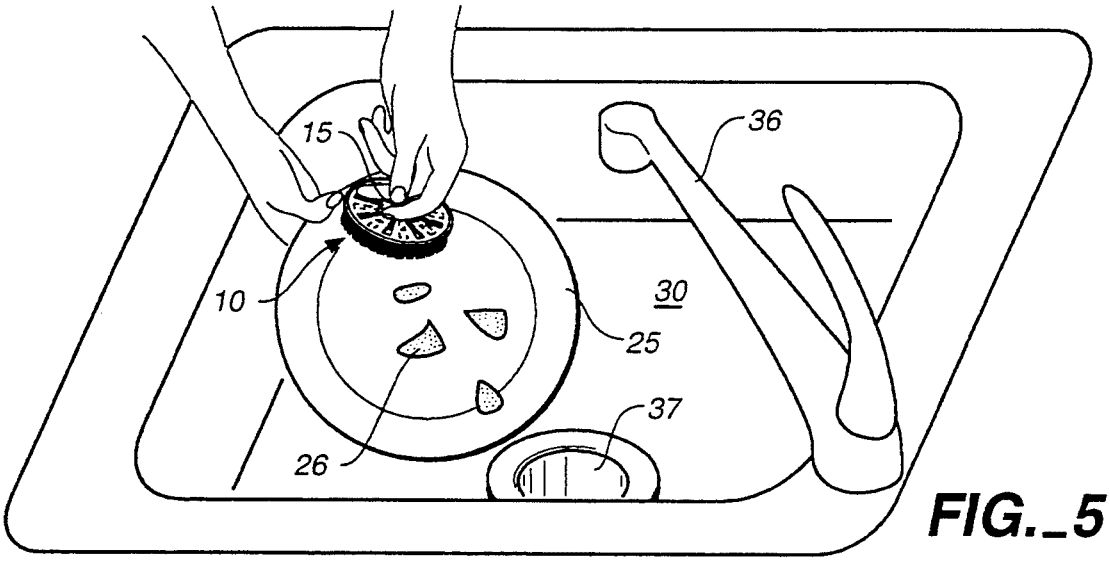
FIG. 5 is a perspective view showing the combined strainer scrub brush and stopper in a scrubbing mode of operation.

FIG. 5 illustrates the scrub brush use of the combined strainer base, brush elements, stopper and handle 10 by a householder manually grasping and holding handle 15 to clean particles 26 off plate 25 so that the particles drop into the disposal 31 fixed below sink 30.

Figure 6:
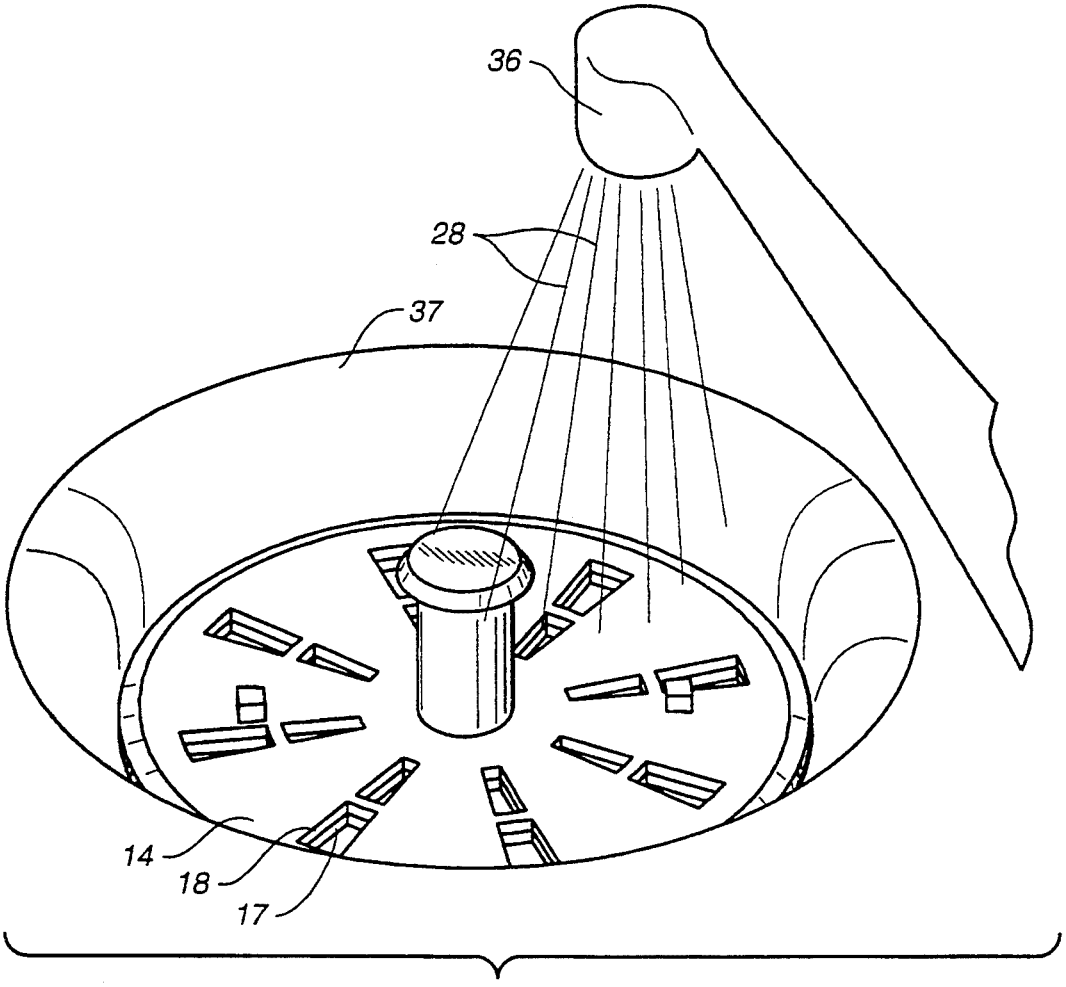
FIG. 6 is a perspective view showing the combined strainer, scrub brush and stopper unit in a straining-flushing mode of operation.

FIG. 6 illustrates the stopper disc holes 18 aligned with the base drain apertures 17 to give a drain "open" condition allowing free drain flow of water 28 from faucet spout 26.

Figure 7:
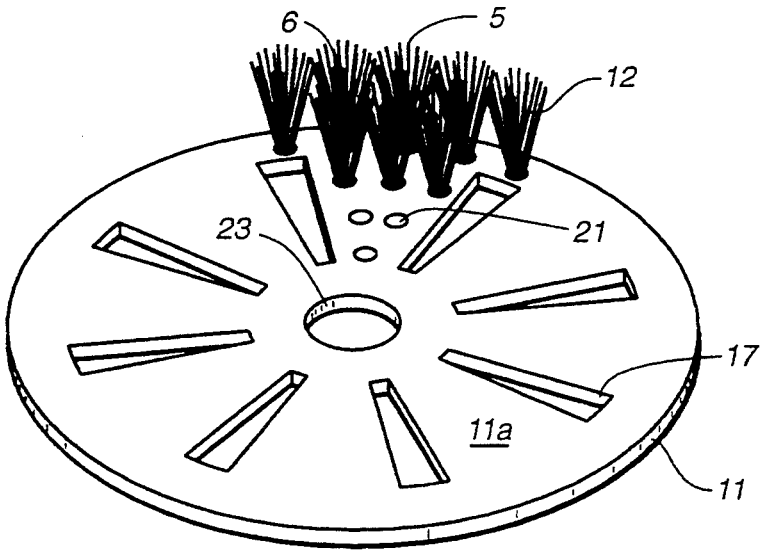
FIG. 7 is a perspective view taken on the underside of the strainer base showing the positioning of the brush elements.

FIG. 7 shows the underside 11*a* of the strainer base in which brush elements 12 are mounted in each semi-quadrant of the space between each of the radial apertures 17. For convenience, only one semi-quadrant is shown partially filled with brush elements. The base end of each brush element may be mounted in an aperture 21 by an epoxy bonding cement or other adhesive.

Figure 8:
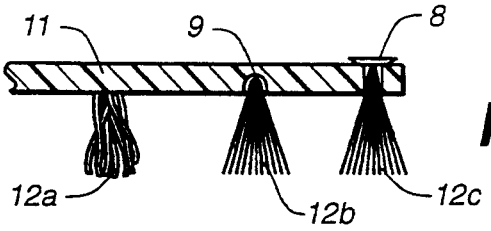
FIG. 8 is a side view of the strainer base showing various arrangement for mounting the brush elements in the strainer base.

FIG. 8 illustrates various brush element or tuft connections. Tufts 12*a* may be made in an integral one-piece plastic construction with strainer base 11 by conventional injection molding techniques. Typically, a nylon or polyprophylene plastic may be employed. A top part of tuft 12*b* may be inserted into and glued by a standard adhesive in an aperture 9. A cylindrical base end 8 of a tuft can be inserted into apertures between the drain apertures 17 in strainer base 11 and a protruding end upset 8*a*, as a rivet, on the upper surface of the strainer base. The latter connection may be employed when a stopper disc is not to be used. As seen in FIG. 7, the tufts may be in a triangular pattern in each semi-quadrant. The tufts extend generally from about 1–4 cm. in length and sized to fit within the disposal inlet.

Figure 9:
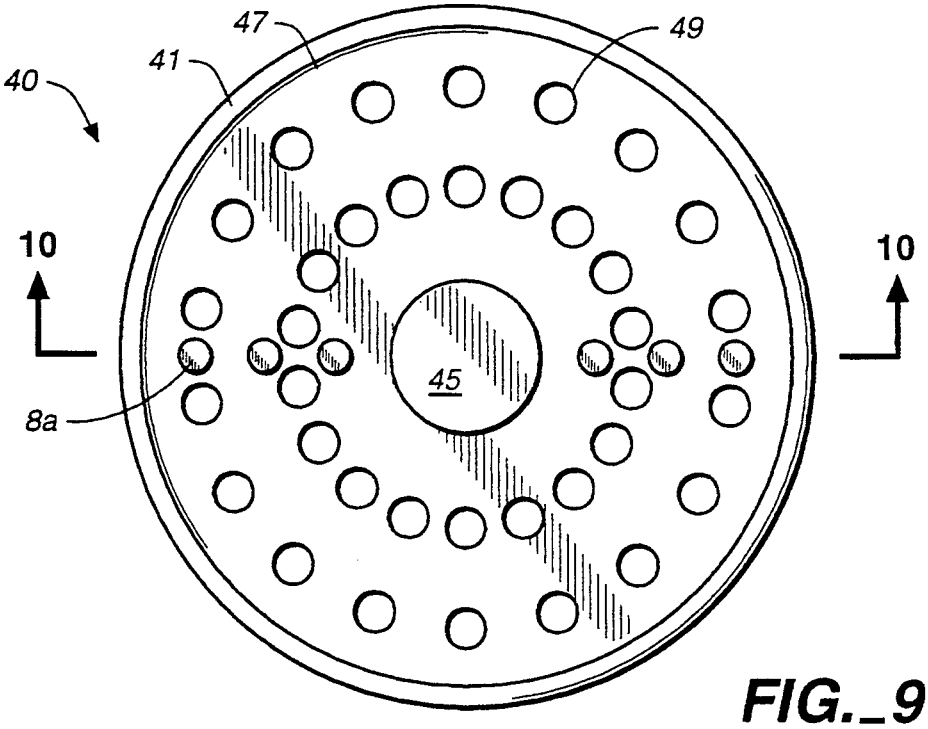
FIG. 9 is a top view of a second embodiment of the invention including a strainer cup with attached brush tufts and without a stopper element.
Figure 11:
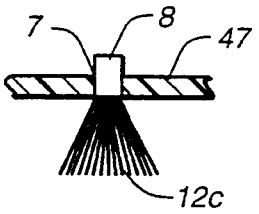
FIG. 11 is a side view partially in section showing the insertion of a brush tuft in an aperture of a strainer bottom.
Figure 12:
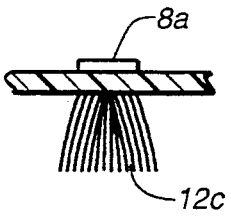
FIG. 12 is a side view partially in section showing the upsetting of the tuft connecting end in the strainer cup.

FIGS. 9–12 show an embodiment of a combined strainer and scrub brush 40 not employing a stopper disc. A more conventional strainer cup 46 having a side wall 41 with drain perforations 44 includes a bottom wall 47 with drain apertures 49 which corresponds to the strainer base 11 shown in FIGS. 1 and 2. Handle 45 is connected to wall 47 by nut 42. Brush tufts 48 extends downwardly from between the drain apertures 49. The brush tufts are preferably constructed of a flexible plastic such as nylon or polyprophylene or a flexible synthetic rubber. The tufts while preferably be of integral one-piece construction with the strainer cup 46, also may be separate plastic extrusions with straight or splayed-out flexible fingers 12*c* and a cylindrical base end 8 (FIG. 11). End 8 is inserted into a cup bottom wall aperture 7 and upset over the bottom inside surface of the cup between drain apertures 49 as seen in FIG. 12. In FIG. 9, only six upset tuft ends are shown. In actual practice, tufts will be provided in circular rows parallel to the circular rows of drain apertures 4*a*. In a preferred embodiment, 9 to 20 equispaced tufts are provided in an outer circular row and 4–10 equispaced tufts are provided in an inner circular row. The fingers may include a central group of fingers 6 and spaced peripheral fingers 5 as seen in FIG. 7.

The above description of embodiments of this invention is intended to be illustrative and not limiting. Other embodiments of this invention will be obvious to those skilled in the art in view of the above disclosure.

I claim:

1. A combined sink strainer and scrub brush comprising:

a circular strainer base having a series of spaced water drain apertures extending therethrough for passage of water from a top side of the strainer base to the underside of the strainer base, said strainer base being adapted to fit into a sink drain;

brush elements extending from an underside of said strainer base, said brush elements being directly mounted to said underside of said strainer base so as to form a single, substantially disc-shaped brush;

a handle connected to an extending upwardly from a central portion of the top side of said strainer base for manipulative removal of said strainer base from within the sink drain and for manipulative use of said brush elements for scrubbing foodstuff-containing surfaces.

2. The combined sink strainer and scrub brush of claim 1 further comprising a rotatable stopper disc extending over all of said spaced drain apertures and in rotative contact with said strainer base, said disc having a series of drain holes generally corresponding to said series of base drain apertures, such that in a first rotational position said disc holes are aligned with said base drain apertures and in a second rotational position said disc holes are offset from said base drain apertures to block off said base drain apertures.

3. The combined sink strainer and scrub brush of claim 2 further comprising means for hand rotation of said stopper disc on a top surface of said stopper disc.

4. The combined sink strainer and scrub brush of claim 3 in combination with a sink drain and in which said means for hand rotation comprises at least one push tab on said top surface of said stopper disc, a top surface of said handle extending upwardly to a position at or below a top surface of the sink drain in a sink-strainer and scrub brush storage position in the sink drain.

5. The combined sink strainer and scrub brush of claim 2 wherein said stopper disc includes a central aperture, said handle extending from said strainer base upward through said central aperture to a position above said strainer base.

6. The combined sink strainer and scrub brush of claim 2 wherein said series of base drain apertures comprise a first series of radial slots and said disc drain holes comprise a second series of radial slots matching the configuration of said first series of radial sets.

7. The combined sink strainer and scrub brush of claim 6 wherein each slot of said first and second series of radial slots comprises a pair of radially aligned slots.

8. The combined sink strainer and brush of claim 1 in which peripheral circular edges of said strainer base and said brush elements are sized to seat in brush storage position within a top cylindrical inlet of a garbage disposal.

9. The combined sink strainer and scrub brush of claim 1 further comprising a rotatable apertured flexible disc overlying a top surface of said strainer base for opening and closing said series of drain perforations.

10. The combined sink strainer and scrub brush of claim 1 wherein said brush elements comprise a series of brush tufts of one-piece construction having a first connecting end fixed to said strainer base and a distal end having a series of flexible fingers for scrubbing purposes.

11. The combined sink strainer and scrub brush of claim 1 wherein said brush elements are disposed in a radially extending patter between said spaced drain apertures.

12. The combined sink strainer and scrub brush of claim 1 in which said substantially disc-shaped brush has a brush surface extending substantially parallel to said underside of said strainer base and extending about 1 cm to about 4 cm from said underside of the strainer base.

13. The combined sink strainer and scrub brush of claim 1 in combination with a sink drain and where a top surface of said handle extends upwardly to a position at or below a top surface of the sink drain in a sink strainer and scrub brush storage position in the sink drain.

14. The combined sink strainer and scrub brush of claim 1 wherein distal ends of said brush elements terminate in a plane substantially parallel to the plane of said strainer base.

15. A combined sink strainer and scrub brush comprising:

a circular open strainer cup having a side peripheral wall and an essentially horizontal strainer cup bottom, said strainer cup being adapted to fit into a sink drain, said strainer cup bottom having a series of spaced drain apertures extending therethrough;

a series of brush tufts connected to an extending substantially downward from an underside of said strainer cup bottom between and immediately adjacent to the series of spaced drain apertures so as to form a single, substantially disc-shaped brush; and a handle connected to and extending from a central portion of a top side of said strainer cup bottom for manipulative removal of said strainer cup from the sink drain and for manipulative use of the brush tufts for scrubbing foodstuff-containing surfaces.

16. The combined sink strainer and scrub brush of claim 15 wherein each of said brush tufts is of one-piece construction comprising a cylindrical connecting end and a distal end having a series of flexible fingers.

17. The combined sink strainer and scrub brush of claim 15 in which said series of tufts are disposed in a circular pattern around said strainer cup bottom and said drain apertures extending concentrically spaced from said series of tufts.

18. The combined sink strainer and scrub brush of claim 17 wherein said series of tufts comprise from about nine to about twenty tufts equispaced and offset from an outer row of said drain apertures in an outer circular row of tufts and from about four to about ten tufts equispaced and offset from an inner row of said drain apertures.

19. The combined sink strainer and scrub brush of claim 15 wherein said strainer cup and said series of brush tufts are made of plastic and said brush tufts are integral with said strainer cup.

20. The combined sink strainer and scrub brush of claim 15 in which said brush tufts have a bottom distal end comprising a series of flexible fingers terminating in a plane substantially parallel to said cup bottom.

21. The combined sink strainer and scrub brush of claim 20 wherein said series of flexible fingers include a grouping of spaced central fingers and a grouping of spaced peripheral fingers concentrically spaced from said spaced central fingers.

* * * * *